US008816881B2

(12) United States Patent
Nakata et al.

(10) Patent No.: US 8,816,881 B2
(45) Date of Patent: Aug. 26, 2014

(54) RUNWAY DIGITAL WIND INDICATOR SYSTEM

(71) Applicants: Roger L. Nakata, Aurora, CO (US); Daniel G. Sprinkle, Aurora, CO (US)

(72) Inventors: Roger L. Nakata, Aurora, CO (US); Daniel G. Sprinkle, Aurora, CO (US)

( * ) Notice: Subject to any disclaimer, the term of this patent is extended or adjusted under 35 U.S.C. 154(b) by 13 days.

(21) Appl. No.: 13/632,371

(22) Filed: Oct. 1, 2012

(65) Prior Publication Data

US 2014/0091952 A1 Apr. 3, 2014

(51) Int. Cl.
*G08G 5/00* (2006.01)

(52) U.S. Cl.
USPC ..... 340/949; 340/947; 340/948; 340/972

(58) Field of Classification Search
USPC ..... 340/949, 963, 961, 968, 971, 972, 947, 340/948; 345/419, 474, 581
See application file for complete search history.

(56) References Cited

U.S. PATENT DOCUMENTS

| | | | | | |
|---|---|---|---|---|---|
| 4,812,844 | A * | 3/1989 | Kallstrom | ..... | 340/949 |
| 5,105,191 | A * | 4/1992 | Keedy | ..... | 340/968 |
| 5,221,924 | A * | 6/1993 | Wilson, Jr. | ..... | 340/968 |
| 5,657,009 | A * | 8/1997 | Gordon | ..... | 340/968 |
| 5,751,289 | A * | 5/1998 | Myers | ..... | 345/419 |
| 6,965,816 | B2 * | 11/2005 | Walker | ..... | 701/16 |

* cited by examiner

*Primary Examiner* — Van T. Trieu

(57) ABSTRACT

A runway digital wind indicator system senses wind conditions at multiple locations, aggregates this data, and communicates up-to-date, usable information to pilots. Meteorological information, including wind speed, direction, and change (i.e., gustiness) plus temperature, humidity, barometer, wind shear, etc., can be sensed by three or more sensor pods placed along a runway (at least one at each end and another in the middle of a given runway). Data from these pods is then transferred to a computer receiver that processes the information into a real-time, concise, readable format that can be displayed to air traffic control, sent to runway digital display signs placed in proximity to runways for direct pilot reference, and/or posted to websites/internet locations that can then be used to wirelessly relay the information to any of a plethora of digital devices that can be accessed directly by a pilot.

20 Claims, 3 Drawing Sheets

RUNWAY DIGITAL WIND INDICATOR SYSTEM

CROSS-REFERENCE TO RELATED APPLICATIONS

This application claims the benefit of U.S. Provisional Application No. 61/741,809 entitled RUNWAY DIGITAL WIND INDICATOR SYSTEM and filed on Jul. 27, 2012, which is specifically incorporated by reference herein for all that it discloses and teaches.

TECHNICAL FIELD

The invention relates generally to the field of aviation, and more particularly to a runway digital wind indicator system.

BACKGROUND

Human beings have been successfully flying powered aircraft for slightly more than one hundred years. During that time, there have been radical improvements in all areas of the field of aviation. However, despite ongoing herculean efforts to improve the safety and reliability of air-travel, incidents and accidents continue to occur. Given the sheer complexity of the aircraft, airports, flight control, piloting methods, meteorology, and other factors that can seriously impact safety, there continue to be many potential causes for accidents and incidents (hereinafter, collectively "accidents").

One of the major causes of aircraft accidents across the world are wind conditions occurring in proximity to a runway as a pilot attempts to land or take-off using that runway. Ideally, calm air conditions or a constant headwind (i.e., a wind blowing towards an airplane out of the direction of travel of the airplane) would be present whenever a plane lands or takes-off from a runway. This is because as wind flows over an aircraft's wings, lift is generated. If the airflow is not directly opposite the direction the aircraft is moving, then lift is reduced. In order to maintain proper flight control, a pilot therefore needs to be aware of the wind conditions along a runway. In response to this need, there are a number of current information systems being used in the art to monitor and report basic wind conditions near airports. Although somewhat minimal in nature, this basic wind information is still quite helpful for pilots attempting to take-off or land their planes. Nevertheless, if wind conditions are rapidly changing, gusting, or varying along different points of a given runway (or along different runways), a pilot can find the basic wind information inadequate at best and woefully misleading and extremely dangerous at worst.

For example, as the airflow of wind over a wing rapidly changes speed or direction, there is a correspondingly rapid change in the lift being generated by the wing. A pilot must then quickly compensate for these changes or risk an accident. If a pilot is informed that the winds at an airport are ten knots (kt) out of the west, he or she may be very surprised to find that at one end of the runway winds are gusting at twenty knots out of the southwest, at ten knots per hour out of the west in the middle of the runway, and fifteen knots per hour from the northwest at the other end of the runway. The sheer size of today's airports can further exacerbate this problem. If a pilot is told that winds are out of the west at twenty knots at Denver International Airport (DIA), for example, he or she must wonder how much the wind information varies along the many runways spread across the fifty three square miles that make up DIA. Thus, current minimal wind conditions information systems are insufficient to properly inform a pilot in order that he or she can maintain control over their aircraft and land or take-off safely.

To further complicate matters, wind information can often change not only from point to point along a runway, but also can quickly change in time as well. For example, the winds can be a generally constant ten knots from the east at one time and then switch to gusting ten to twenty knots from the west minutes later. As current minimal wind indicator systems are often slow to update and rarely provide up to the minute information, additional problems can develop for a pilot relying on such untimely, out-of-date information. In fact, current automated weather detection sites such as Surface Weather Observation Stations (ASOS) or Automated Weather Observation Stations (AWOS) can provide as little as a single reading within an hour and may be located miles from a given runway.

What is needed is a real-time runway digital wind indicator system that can sense and report wind information from multiple locations along a runway as well as from the centerfield location (near a center point for a given airport) in a constantly updating, real-time manner without burying pilots with too much information.

SUMMARY

One embodiment of the present invention comprises a system for sensing wind conditions at multiple locations, aggregating this data, and communicating up-to-date information to pilots. For example, meteorological information including wind speed, direction, and change (i.e., gustiness) plus temperature, humidity, barometric pressure, etc. can be sensed by three or more sensor pods placed along a runway (at least one at each end and another in the middle of a given runway). Data from these pods is then transferred to a computer receiver that processes the information into a concise, usable format that can be displayed to air traffic control, sent to runway digital display signs placed in proximity to runways for direct pilot reference, or posted to websites/internet locations that can then be used to wirelessly relay the information to any of a plethora of digital devices that can be accessed directly by a pilot.

For example, before beginning a final approach to land his airplane, a pilot could examine his tablet computer and reference a webpage for a given airport and runway. The runway digital wind indicator system will have sensed the wind information at the approach, midpoint and departure locations (i.e., both ends and the middle of a runway) plus at the centerfield of the airport. The system then aggregates and processes this data into a concise, easily readable information set that is posted real-time, up to the second, on the webpage that the pilot can view on his tablet computer. He then has a much-enhanced understanding of the wind conditions along his runway and can then be prepared for the wind environment he and his plane will experience upon landing.

DETAILED DESCRIPTION

Figure 1:
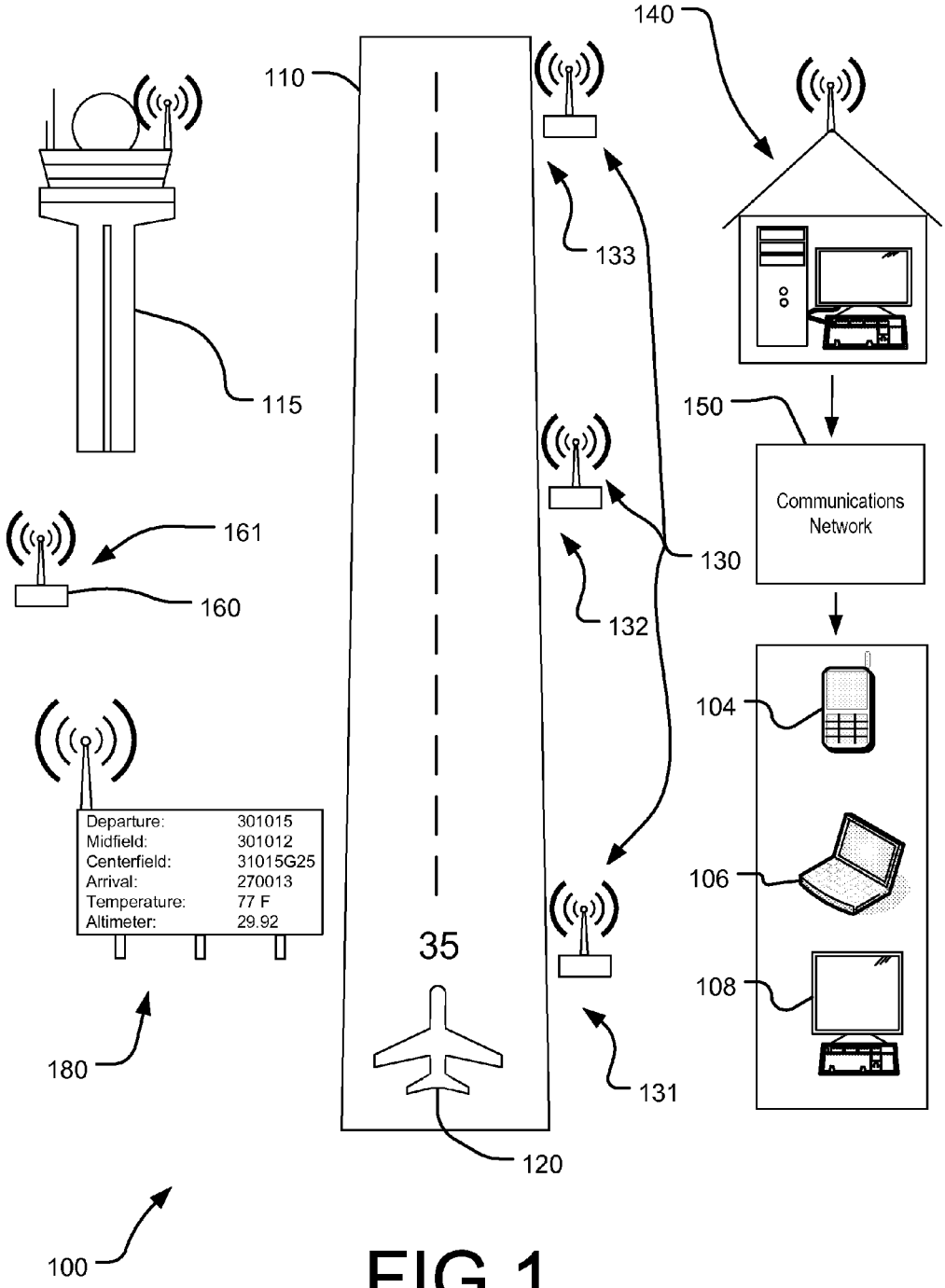
FIG. 1 shows a perspective view of an exemplary embodiment of a runway digital wind indicator system.

Referring now to the drawings, FIG. 1 shows a perspective view of an exemplary embodiment of a runway digital wind indicator system 100. In the center of FIG. 1, the runway 110 is shown with a representation of an aircraft 120 awaiting clearance for departure at one end of the runway 110. In another embodiment, the aircraft 120 can already be in the air and planning on landing on the runway 110. In either case, a plurality of wind sensors 130 is placed in proximity to the runway 110. In the embodiment shown in FIG. 1, there are three wind sensors 130, in other embodiments the plurality of wind sensors 130 can be greater than three. Additionally, a centerfield wind sensor 160 can also be incorporated in the system. Such a sensor is preferably located at a point near the center of the airport, i.e., the centerfield location 161. In FIG. 1, the centerfield location 161 is near the representation of the air traffic control tower 115, as such an edifice is often centrally located.

The wind sensors 130 are preferably placed in elevated positions (for example, on poles) in order to be in the optimum position to properly sense current meteorological information. At a minimum, the plurality of wind sensors 130 should measure the wind speed and direction. Whenever the term "wind sensor" 130 is used herein, it should be understood to encompass at least wind speed and direction sensing, and can also include additional sensors to determine temperature, humidity, pressure, wind shear, rate of change (change in readings/speed/direction, etc. over time), and other data points. The plurality of wind sensors 130 can be linked (i.e., in electronic communication) either wirelessly or wired (or both) with a central computer receiver 140. In the embodiment in FIG. 1, wireless transceivers are illustrated as antennas.

The central computer receiver 140 receives sensor data from the plurality of wind sensors 130. In another embodiment, the computer receiver 140 can also receive data from existing sensors/systems and integrate the data into the new runway digital wind indicator system. The computer then processes this data and aggregates it into concise, easily digestible information that is ready to be displayed via a communications network 150 (e.g., the internet) using internet data, websites, webpages, apps, etc., (collectively, "internet communications"), on a hand-held computing device 104 (such as a tablet computer, mobile smart phone, etc.), a laptop computer 106, or other computing device 108 in a constantly updating, real-time manner. Additionally, the computer receiver 140 can route the information to an air traffic controller in the control tower 115 and to a runway digital display sign 180. This can be accomplished wirelessly or over physical lines. The information can be made available not just to air traffic controllers (or other tower/airport personnel) but to anyone else that could utilize the information via one or more communications networks 150. In the case of utilizing existing wind systems, the communications network 150 will take the Air Traffic Control wind information and display it on the hand-held computing device 104, a laptop computer 106, or other computing device 108 and/or the runway digital display sign 180.

As shown in FIG. 1, an exemplary runway digital display sign (RDDS) 180 can display real-time information such as wind direction: "301" (degrees), and speed: "015" (knots, or kt) at the departure location 131 on the runway 110. Also shown on the RDDS 180 in the embodiment of FIG. 1, are wind speed and direction at the midfield location 132, centerfield location 161, and arrival location 133; temperature at the centerfield; and barometric pressure reading (i.e., Altimeter) at the centerfield. Note that the wind speed and direction line item for the Centerfield location also displays wind gust information: winds are from 310 degrees at 15 knots, gusting to 25 knots. In other embodiments, the wind gust information is available for other locations. In yet other embodiments, the RDDS 180 can display other information. Furthermore, the number of runway digital display signs 180 can be two or more (one at each end of each runway 110, for example).

It is important to understand that although the embodiment illustrated in FIG. 1 only shows a single runway, the system is designed to handle multi-runway airports as well. In such a case, the number of runway digital display signs, wind sensors, etc. would be increased to accommodate additional runways. The central computer receiver 140 may need to be expanded or upgraded to handle the additional load; alternatively, additional computer receivers 140 can be added to the system. The computer receiver 140 processes the raw data inputs from all the wind sensors into constantly updated, usable, actionable information. Calculations are made on an ongoing basis to provide smooth data that is easily readable and yet up-to-date.

Figure 2:
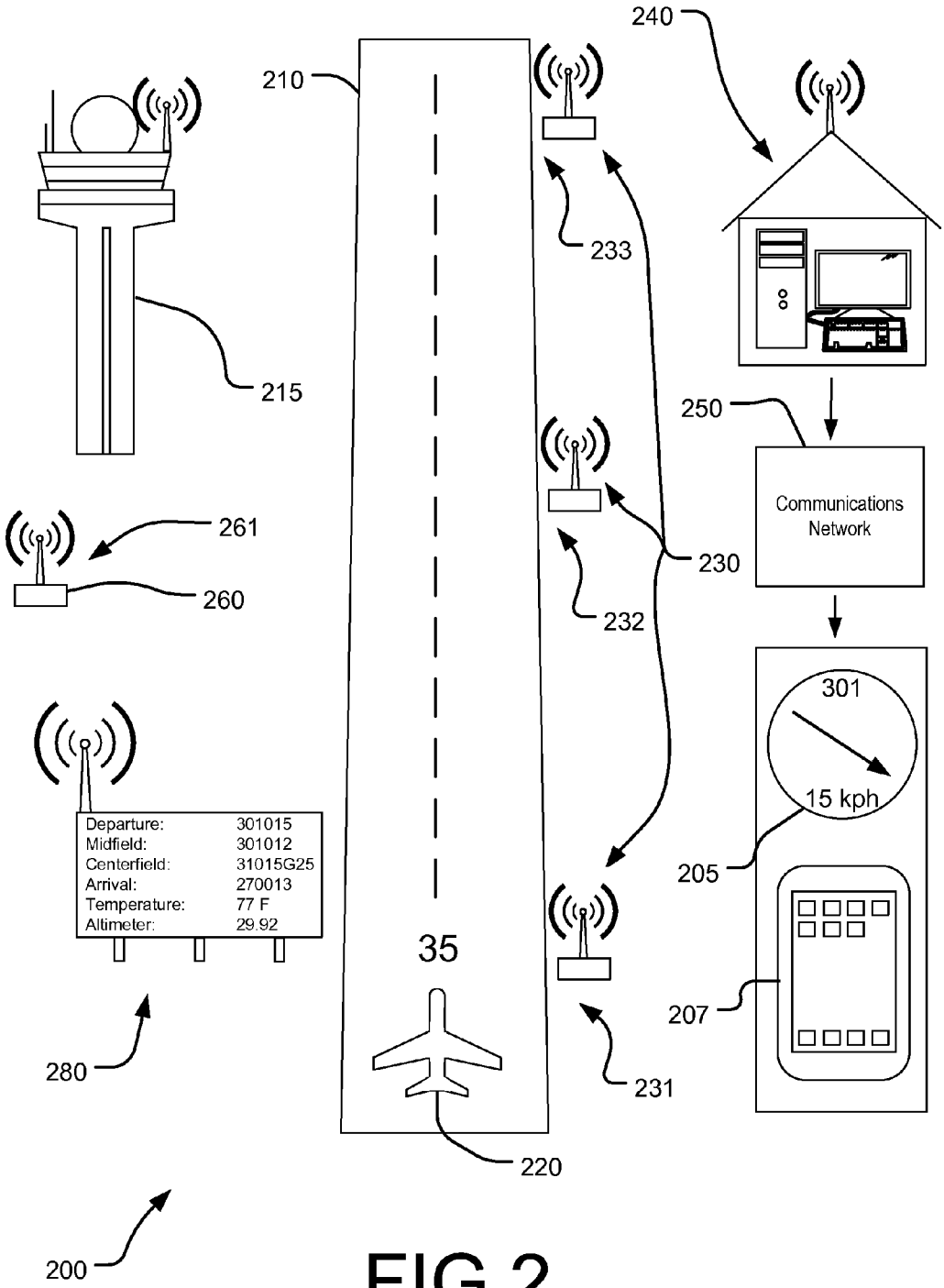
FIG. 2 illustrates a perspective view of an additional exemplary embodiment of a runway digital wind indicator system.

FIG. 2 illustrates a perspective view of an additional exemplary embodiment of a runway digital wind indicator system 200. In the center of FIG. 2, the runway 210 is shown with a representation of an aircraft 220 waiting to depart from one end of the runway 210. In this embodiment, the pilot can view the wind information on the RDDS 280 or on his or her electronic device 207 in the cockpit of the airplane 220. Alternatively, a plurality of instruments 205 can be installed or placed in the cockpit to display the information (in the example illustrated in FIG. 1, a round display instrument shows an arrow to indicate the direction in which the wind is blowing, the degrees from which the wind is blowing: 301, and the speed: 15 knots). The information displayed is based on data gathered by a plurality of wind sensors 230. In other embodiments, additional instruments or more complex instruments would be used to display the data from all the wind sensors; or as requested by the pilot.

The plurality of wind sensors 230 is placed in proximity to the runway 210. In the embodiment shown in FIG. 2, there are three wind sensors 230 in proximity to the runway 210, in other embodiments the plurality of wind sensors 230 can be greater than three. Additionally, a centerfield wind sensor 260 can also be incorporated in the system. Such a sensor is ideally located at a centerfield location 261 near the center of the airport. In FIG. 2 it is near the representation of the control tower 215.

At a minimum, the plurality of wind sensors 230 should measure the wind speed and direction. Additional sensors can be incorporated in the wind sensor 230 pods to include temperature, humidity, barometric pressure (and rate of change thereof, or at least whether it is rising or falling), rate of change in wind speed/direction, etc. The plurality of wind sensors 230 can be linked either wirelessly or wired (or both) to a central computer receiver 240.

The central computer receiver 240 receives sensor data from the plurality of wind sensors 230 (including the centerfield sensor 260). In another embodiment, the computer receiver 240 can also receive data from existing sensors/systems and integrate the data into the new runway digital wind indicator system. The computer than processes this data and aggregates it into concise, easily digestible information that is ready to be displayed in real-time via an electronic device 207 (e.g., an IPad® or other tablet computing device) and/or to a runway digital display sign 280.

As shown in FIG. 2, an exemplary runway digital display sign (RDDS) 280 can display real-time information such as wind direction: "301" (degrees), and speed: "015" (knots) take from the departure location 231 on the runway 210. Also shown on the RDDS 280 in the embodiment of FIG. 2, are wind speed and direction at the midfield location 232 (301 degrees and 12 knots), centerfield location 261, and arrival location 233; temperature at the centerfield location 261; and barometric pressure reading (altimeter) at the centerfield location 261. Note that the wind speed and direction line item for the Centerfield location 261 also displays wind gust information: winds are from 310 degrees at 15 knots, gusting to 25 knots. In other embodiments, the RDDS 280 can display other information (for example, gusts can be displayed for locations other than centerfield, midfield, arrival, or departure; as another example, wind shear information can be displayed). Furthermore, the number of runway digital display signs 280 can be two or more (one at each end of the runway 210, for example).

Figure 3A:
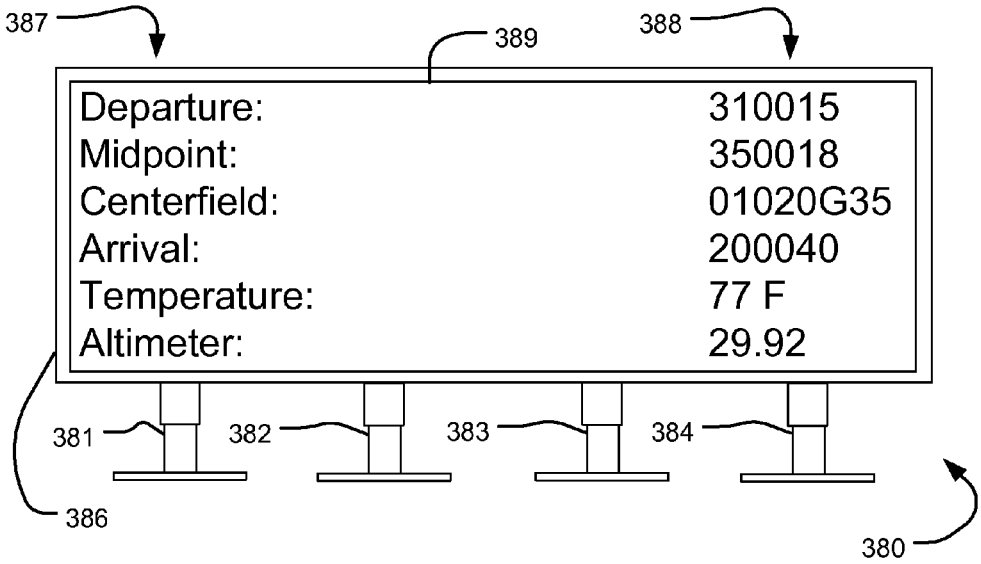
FIG. 3A illustrates a front elevation view of an exemplary embodiment of a runway digital display sign.

FIG. 3A illustrates a front elevation view of an exemplary embodiment of a runway digital display sign 380. As in FIGS. 1 and 2 above, the RDDS 380 can display the wind direction, speed, and even gusts for departure, midfield, centerfield, and arrival locations; plus temperature; barometric pressure (Altimeter), wind shear, etc. In the views shown in FIG. 3, an exemplary size and shape RDDS 380 are illustrated. The dimensions of the RDDS 380 can vary in other embodiments.

The RDDS has a main support body 386 comprising the structure and frame of the RDDS. It is secured to the ground or other solid surface by a plurality of stanchions 381, 382, 383, and 384. FIG. 3A illustrates four stanchions 381-384, in other embodiments, other numbers and types of stanchions can be employed. Although not shown in FIG. 3A, the stanchions 381-384 can be attached to, or embedded in, a concrete footer or other support structure.

The main support body 386 enfolds the display 389. The display 389 shows the airplane's pilot(s) information from the computer receiver. Although there are many possible ways to display the information, that shown in FIG. 3A is a two column 387 and 388 format with the first column 387 listing the fields and the second column 388 displaying the associated data for each field. For example, the first row contains the field "Departure" and the data point "310015". This is a short-hand way of stating that at the departure location on this runway, the wind is from 310 degrees and is blowing at 15 knots. Although no delineator is shown in FIG. 3A, a period, dash, space, comma, etc. could be used to separate the degrees from the knots. Also, the text could be displayed in different colors. For example, if the winds are strengthening, the "015" could be in red, and if they are weakening, the "015" could be green. As another example, if the knots reading is between zero and ten, it could be displayed in green, between 10 and 20 it could be displayed in yellow, and winds over 20 knots could be displayed in red. Additional information such as increasing or decreasing trends could be displayed as a plus sign or minus sign, respectively, after the knots number. Furthermore, the information could be displayed graphically rather than numerically (for example, an arrow pointing in the direction the wind is blowing and colored as above). Such graphical representations could also be used on computing devices, websites, etc. and the individual pilot or user could customize the type of graph, text, graphical representation, etc. he or she likes to use.

Figure 3B:
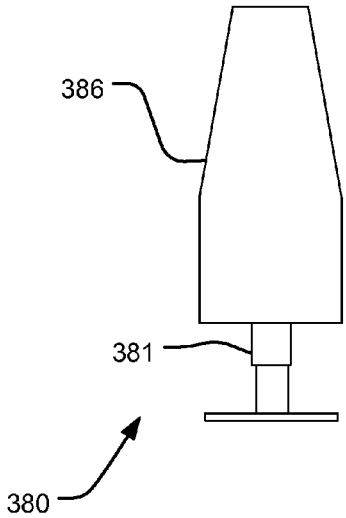
FIG. 3B illustrates a side elevation view of an exemplary embodiment of a runway digital display sign.

FIG. 3B illustrates a side elevation view of an exemplary embodiment of a runway digital display sign 380. The main support body 386 and one stanchion 381 are visible.

While particular embodiments of the invention have been described and disclosed in the present application, it should be understood that any number of permutations, modifications, or embodiments may be made without departing from the spirit and scope of this invention. Accordingly, it is not the intention of this application to limit this invention in any way except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

In light of the above "Detailed Description," the Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The above specification, examples and data provide a description of the structure and use of exemplary implementations of the described articles of manufacture and methods. It is important to note that many implementations can be made without departing from the spirit and scope of the invention.

What is claimed is:

1. A runway digital wind indicator system, configured to communicate information concerning conditions at a first location, a second location, and a third location along a runway, the system comprising:

a first wind sensor positioned at a departure location which is located near that portion of the runway from which an aircraft is waiting to depart, a second wind sensor positioned at a midfield location which is located at approximately the midpoint of the runway, and a third wind sensor positioned at an arrival location which is located at the opposite end of the runway from the departure location, wherein each location is in proximity to the runway, and the plurality of wind sensors are designed to accurately sense and report in real-time at least wind speed and wind direction data;

a computer receiver in electronic communication with the plurality of wind sensors, the computer receiver configured to receive at least wind speed and wind direction data from the plurality of sensors and to process the data into usable information; and a runway digital display sign positioned in proximity to the departure location and configured to visually display the real-time, usable information to a pilot in the aircraft on the runway waiting to depart, so that the pilot can see that at the departure location a first wind speed and a first wind direction exist, and at the midfield location a second wind speed and a second wind direction exist, and at the arrival location a third wind speed and a third wind direction exist.

2. The runway digital wind indicator system of claim 1 wherein the computer receiver is in electronic communication with a fourth wind sensor, the fourth wind sensor is positioned in proximity to a centerfield location near a center of an airport and is configured to send at least real-time centerfield wind speed and wind direction data to the computer receiver, the computer receiver is configured to incorporate the centerfield data into the usable information, and the digital display sign is configured to visually display to the pilot that at the centerfield location, a fourth wind speed and a fourth wind direction exist.

3. The runway digital wind indicator system of claim 2, further comprising the computer receiver using a communications network to display the real-time usable information to the pilot via a portable computing device that is wirelessly connected to the communications network.

4. The runway digital wind indicator system of claim 2, wherein the computer receiver uses a communications network to display the real-time usable information in the form of internet communications that can be viewed on a tablet computer, mobile phone, or other electronic device accessible by the pilot from within the aircraft.

5. The runway digital wind indicator system of claim 2, wherein the computer receiver is in electronic communication with an air traffic control tower and the real-time usable information can be displayed via a tablet computer, mobile phone, digital screen, computer, or other electronic device in the air traffic control tower.

6. The runway digital wind indicator system of claim 2, wherein the computer receiver is in electronic communication with at least one instrument in the aircraft and the real-time usable information is displayed to the pilot on the instrument.

7. The runway digital wind indicator system of claim 1, further comprising the computer receiver using a communications network to display the real-time usable information to the pilot via a portable computing device that is wirelessly connected to the communications network.

8. The runway digital wind indicator system of claim 1, wherein the computer receiver uses a communications network to display the real-time usable information in the form of internet communications that can be viewed on a tablet computer, mobile phone, or other electronic device accessible by the pilot from within the aircraft.

9. The runway digital wind indicator system of claim 1, wherein the computer receiver is in electronic communication with an air traffic control tower and the real-time usable information can be displayed via a tablet computer, mobile phone, digital screen, computer, or other electronic device in the air traffic control tower.

10. The runway digital wind indicator system of claim 1, wherein the computer receiver is in electronic communication with at least one instrument in the aircraft and the real-time usable information is displayed to the pilot on the instrument.

11. A runway digital wind indicator system, configured to communicate information concerning conditions at a first location, a second location, and a third location along a runway, plus at a centerfield location, the system comprising:

a plurality of wind sensors comprising a first wind sensor, a second wind sensor, a third wind sensor and a fourth wind sensor;

the first wind sensor positioned at a departure location which is located near that portion of the runway from which an aircraft is waiting to depart, the second wind sensor positioned at a midfield location which is located at approximately the midpoint of the runway, the third wind sensor positioned at an arrival location which is located at the opposite end of the runway from the departure location, and the fourth wind sensor positioned at the centerfield location in proximity to a center of an airport, wherein the plurality of wind sensors are designed to accurately sense and report in real-time at least wind speed and wind direction data;

a computer receiver in electronic communication with the plurality of wind sensors, the computer receiver configured to receive at least wind speed, wind direction, wind gustiness reading, temperature, and pressure data from the plurality of sensors and to process the data into usable information; and a runway digital display sign positioned in proximity to the departure location and configured to visually display the real-time, usable information to a pilot in the aircraft on the runway waiting to depart so that the pilot can see that at the departure location a first wind speed and a first wind direction exist, and at the midfield location a second wind speed and a second wind direction exist, and at the arrival location a third wind speed and a third wind direction exist, and at the centerfield location a fourth wind speed, a fourth wind direction, a wind gustiness reading, a temperature, and a pressure exist.

12. The runway digital wind indicator system of claim 11, further comprising the computer receiver using a communications network to display the real-time, usable information to the pilot via a portable computing device that is wirelessly connected to the communications network.

13. The runway digital wind indicator system of claim 12, wherein the computer receiver uses a communications network to display the real-time usable information in the form of internet communications that can be viewed on a tablet computer, mobile phone, or other electronic device accessible by the pilot from within the aircraft.

14. The runway digital wind indicator system of claim 13, wherein the computer receiver is in electronic communication with an air traffic control tower and the real-time usable information can be displayed via a tablet computer, mobile phone, digital screen, computer, or other electronic device in the air traffic control tower.

15. The runway digital wind indicator system of claim 14, wherein the computer receiver is in electronic communication with at least one instrument in the aircraft and the real-time usable information is displayed to the pilot on the instrument.

16. The runway digital wind indicator system of claim 12, wherein the computer receiver is in electronic communication with an air traffic control tower and the real-time usable information can be displayed via a tablet computer, mobile phone, digital screen, computer; or other electronic device in the air traffic control tower.

17. The runway digital wind indicator system of claim 1 wherein the computer receiver uses a communications network to display the real-time usable information in the form of internet communications that can be viewed on a tablet computer, mobile phone, or other electronic device accessible by the pilot from within the aircraft.

18. The runway digital wind indicator system of claim 17, wherein the computer receiver is in electronic communication with an air traffic control tower and the real-time usable information can be displayed via a tablet computer, mobile phone, digital screen, computer, or other electronic device in the air traffic control-tower.

19. The runway digital wind indicator system of claim 11, wherein the computer receiver is in electronic communication with an air traffic control tower and the real-time usable information can be displayed via a tablet computer, mobile phone, digital screen, computer, or other electronic device in the air traffic control tower.

20. The runway digital wind indicator system of claim 11, wherein the computer receiver is in electronic communication with at least one instrument in the aircraft and the real-time usable information is displayed to the pilot on the instrument.

* * * * *